US010094514B1

(12) United States Patent
Sammataro et al.

(10) Patent No.: US 10,094,514 B1
(45) Date of Patent: Oct. 9, 2018

(54) SELF-CLOSING DRAIN PLUGS WITH REDUNDANT SEALING

(71) Applicant: Sikorsky Aircraft Corporation, Stratford, CT (US)

(72) Inventors: Stephen R. Sammataro, Madison, CT (US); Yuriy Dmytrenko, Shelton, CT (US)

(73) Assignee: SIKORSKY AIRCRAFT CORPORATION, Stratford, CT (US)

( * ) Notice: Subject to any disclaimer, the term of this patent is extended or adjusted under 35 U.S.C. 154(b) by 0 days.

(21) Appl. No.: 15/601,621

(22) Filed: May 22, 2017

(51) Int. Cl.

| | |
|---|---|
| ***F16N 21/00*** | (2006.01) |
| ***F16K 15/06*** | (2006.01) |
| ***F16K 15/18*** | (2006.01) |
| ***F16N 19/00*** | (2006.01) |

(52) U.S. Cl.
CPC ..... *F16N 21/00* (2013.01); *F16K 15/063* (2013.01); *F16K 15/18* (2013.01); *F16N 19/00* (2013.01); *F16N 2280/00* (2013.01)

(58) Field of Classification Search
CPC . Y10T 137/88062; F16N 21/00; F16N 19/00; F16K 15/18; F16K 31/528; F16K 51/00; F16K 15/063
USPC ..... 137/613, 800, 614.21
See application file for complete search history.

(56) References Cited

U.S. PATENT DOCUMENTS

| | | | | |
|---|---|---|---|---|
| 1,954,986 | A | 4/1934 | Carlson et al. | |
| 2,983,385 | A | 5/1961 | Botstiber | |
| 4,386,639 | A | 6/1983 | Gable et al. | |
| 4,447,040 | A * | 5/1984 | Magorien | F16L 37/32 137/508 |
| 6,027,315 | A * | 2/2000 | Hogan | F04B 39/16 137/523 |
| 6,293,300 | B1 * | 9/2001 | Dumke et al. | F16K 1/446 137/312 |
| 6,612,327 | B2 * | 9/2003 | Knowles et al. | B67D 7/3209 137/205 |
| 2004/0188335 | A1 * | 9/2004 | Horan | F01M 11/0408 210/222 |

* cited by examiner

*Primary Examiner* — Kevin Lee
(74) *Attorney, Agent, or Firm* — Cantor Colburn LLP

(57) ABSTRACT

A drain plug assembly includes a valve body, a removable closure, a poppet, and a resilient member. The valve body has a central bore extending between an inlet and an axially opposite outlet. The bore has a seat arranged between the inlet and outlet. The closure has an unseated and seated position, the closure cooperating with the seat to form an outer seal in the seated position. The poppet is arranged in the bore on a side of the seat opposite the outlet and has open and closed positions, the poppet cooperating with the seat to form an interior seal in the closed position. The resilient member is arranged between the valve body and the poppet for fluidly isolating the inlet from the outlet irrespective of the closure position. A snap ring and locking spline arrange are incorporated to prevent removal of the valve body during service.

20 Claims, 3 Drawing Sheets

SELF-CLOSING DRAIN PLUGS WITH REDUNDANT SEALING

BACKGROUND OF THE INVENTION

1. Field of the Invention

The present disclosure relates to lubrication systems, and more particularly to drain plugs for lubricant systems such as in rotorcraft transmissions.

2. Description of Related Art

Lubrication systems, such as those found in transmissions in vehicles, commonly include a sump to collect lubricant returning from lubricated components like gears and bearings. The sump generally stores the lubricant between cycles through the lubrication system. Since lubricant periodically requires replacement sumps commonly have a drain and a fill, the drain allowing lubricant to be removed from the lubricant system and the fill allowing re-filling the system with replacement lubricant. Draining is typically accomplished by removing a drain plug fitted to a lower recess of the sump, thereby allowing lubricant contained within the sump to drain with the assistance of gravity. Once drained, the plug is reinstalled and the sump refilled.

Since loss of lubrication can lead to damage of lubricated components the drain plug is typically re-installed with care subsequent to draining the sump. Some drain plugs are re-installed with a crush washer that seats about the drain plug and deforms according to a torque applied by a maintainer during re-installation of the drain plug. The torque causes the washer exert a tensile retaining force on the drain plug that resists vibration that could otherwise loosen the drain plug, and the washer is generally replaced each time the sump is drained.

Such conventional drain plugs and methods of sealing drain plug/sump interfaces have generally been considered satisfactory for their intended purpose. However, there is still a need in the art for improved drain plugs and extremely reliable methods of sealing the drain plug/sump interfaces. The present disclosure provides a solution for this need.

SUMMARY OF THE INVENTION

A drain plug assembly includes a valve body, a removable closure, a poppet, and a resilient member. The valve body has a central bore that extends between an inlet and an outlet of the valve body. The bore has a seat that is arranged between the inlet and outlet. The closure has an unseated and seated position, the closure cooperating with the seat to form an outer seal when in the seated position. The poppet is arranged in the bore on a side of the seat opposite the outlet and has open and closed positions, the poppet cooperating with the seat to form an interior seal when in the closed position. The resilient member is arranged between the valve body and the poppet to bias the poppet towards the closed position to fluidly isolate the inlet from the outlet irrespective of the closure position.

In certain embodiments, the poppet can be disposed on a side of the inlet opposite the seat when the poppet is in the open position. The valve body inlet can extend laterally through the valve body. The valve body outlet can extends longitudinally through the valve body. A poppet biasing member can be arranged between the valve body and the poppet. The poppet biasing member can be arranged to bias the poppet towards the poppet closed position.

In accordance with certain embodiments, the closure can include a stem and a head. The stem can be connected to the head. The stem can extend longitudinally through the central bore when the closure is in the seated position. The valve body can have an external threaded segment longitudinally overlapping the valve body seat. A bayonet connection can couple the closure to the valve body when the closure is in the seated position. The closure can include a plunger. The plunger can be slidably seated on the stem longitudinally opposite the head.

It is contemplated that that the closure can include a plunger biasing member. The plunger biasing member can be arranged between the head and the plunger. The plunger biasing member can be configured to bias the plunger toward the end of the stem opposite the head. A ball retention arrangement can couple to the closure of the valve body in the seated position. An external seal member can extend about the valve body longitudinally between the seat and the outlet. The external seal member can cooperate with the closure to form a secondary external seal when the closure is in the seated position.

It is also contemplated that, in accordance with certain embodiments, a static seal member can extend circumferentially about the valve body and longitudinally between the seat and the outlet. A lock ring can be seated about the valve body on a side of the static seal member opposite the seat. The valve body can have an external spline arranged longitudinally between the static seal and the outlet to fix the valve body relative to the lock ring.

A sump arrangement includes a sump with a drain and a drain plug assembly as described above. A lock ring is arranged in the drain between the valve body and the sump. A spline arranged on the valve body exterior engages the lock and prevents removal of the valve body.

A drain plug kit includes a drain plug assembly, a ring lock, and a retention clip as described above. The poppet is arranged for self-closure of the valve body bore with an internal seal. The closure is arranged for redundant sealing of the valve body bore with a primary external seal and a secondary exterior seal. The ring lock is arranged to seat about the valve member between the outlet and the core for permanently fixing the valve body in a sump drain. The retention clip is arranged to seat about a portion valve body longitudinally between the seat and the outlet and configured to prevent removal of the closure from the valve body outlet.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION OF THE PREFERRED EMBODIMENTS

Figure 1:
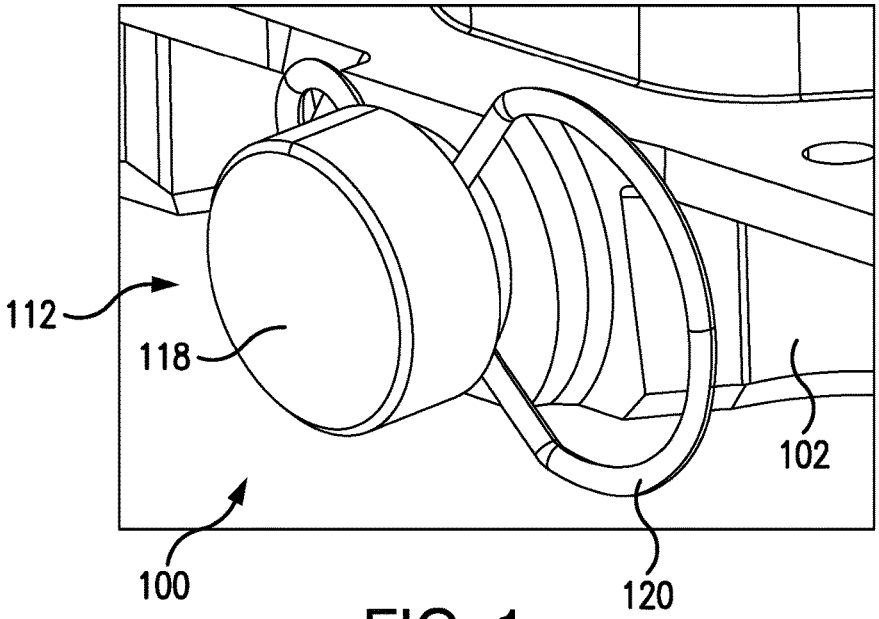
FIG. 1 is a perspective view of a sump arrangement constructed in accordance with the present disclosure, showing a lubricant sump having a drain plug assembly with a closure and a retention clip seated in the sump.

Reference will now be made to the drawings wherein like reference numerals identify similar structural features or aspects of the subject disclosure. For purposes of explanation and illustration, and not limitation, a partial view of an exemplary embodiment of a drain plug assembly in accordance with the disclosure is shown in FIG. 1 and is designated generally by reference character 100. Other embodiments of drain plug assemblies, sump arrangements, and drain plug assembly kits in accordance with the disclosure, or aspects thereof, are provided in FIGS. 2-4, as will be described. The systems and methods described herein can be used to provide self-closing drain plugs with redundant sealing in rotorcraft lubrication systems, though the present disclosure is not limited to rotorcraft or to lubrication systems in general.

Figure 2:
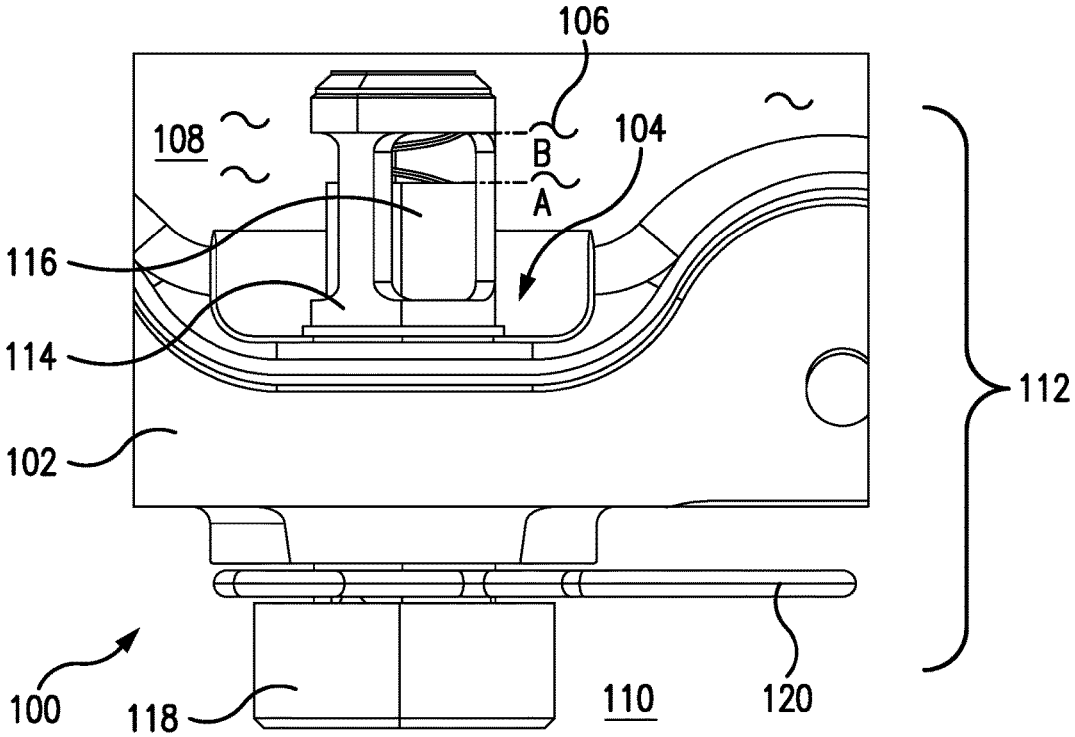
FIG. 2 is a sectioned top view of a portion of the sump arrangement of FIG. 1, showing a valve body and poppet of the drain plug assembly.

Referring to FIGS. 1 and 2, a sump arrangement 100 is shown. Sump arrangement 100 includes a sump 102 with a drain 104 and containing a lubricant 106. Drain 104 extends between an interior 108 and an exterior 110 of sump 102. A drain plug assembly 112 is arranged within drain 104 and configured to impound lubricant 106 within interior 108 with redundant sealing. Drain plug assembly 112 includes valve body 114 with a poppet 116, a removable closure 118, and a retention clip 120 to prevent removal of closure 118 from valve body 114.

Poppet 116 is arranged within sump interior 108 to provide self-closure and sealing of valve body 114. In this respect poppet 116 is arranged to move between a closed position A (shown in FIG. 2) and an open position B (shown in FIG. 2). In the closed position A poppet 116 forms an internal seal 122 (shown in FIG. 3) between poppet 116 and valve body 114 within an interior of valve body 114. In the open position poppet 116 allows fluid communication between interior 108 and exterior 110. Poppet 116 is arranged to automatically move to the closed position A absent application of an actuation force. The actuation force can be provided, for example, by insertion of an actuator 124 (shown in FIG. 4) into valve body 114, which moves poppet 116 from closed position A to open position B to allow lubricant 106 to issue from interior 108 to the external environment 110 through valve body 114.

Closure 118 is arranged for insertion into valve body 114 to provide redundant sealing of valve body 114. In this respect closure 118 is arranged for manual insertion into valve body 114 in a seated position C (shown in FIG. 3) and movement therefrom to an unseated position D (shown in FIG. 3) wherein closure 118 does not provide sealing within valve body 114, e.g., such as when closure 118 is removed from drain plug assembly 118. Once inserted into valve body 114 and arranged in the seated position C closure 118 fluidly isolates interior 108 of sump 102 from exterior 110 with a primary external seal 126 (shown in FIG. 3) and a secondary external seal 128 (shown in FIG. 3) providing redundant sealing of valve assembly 100.

Figure 4:
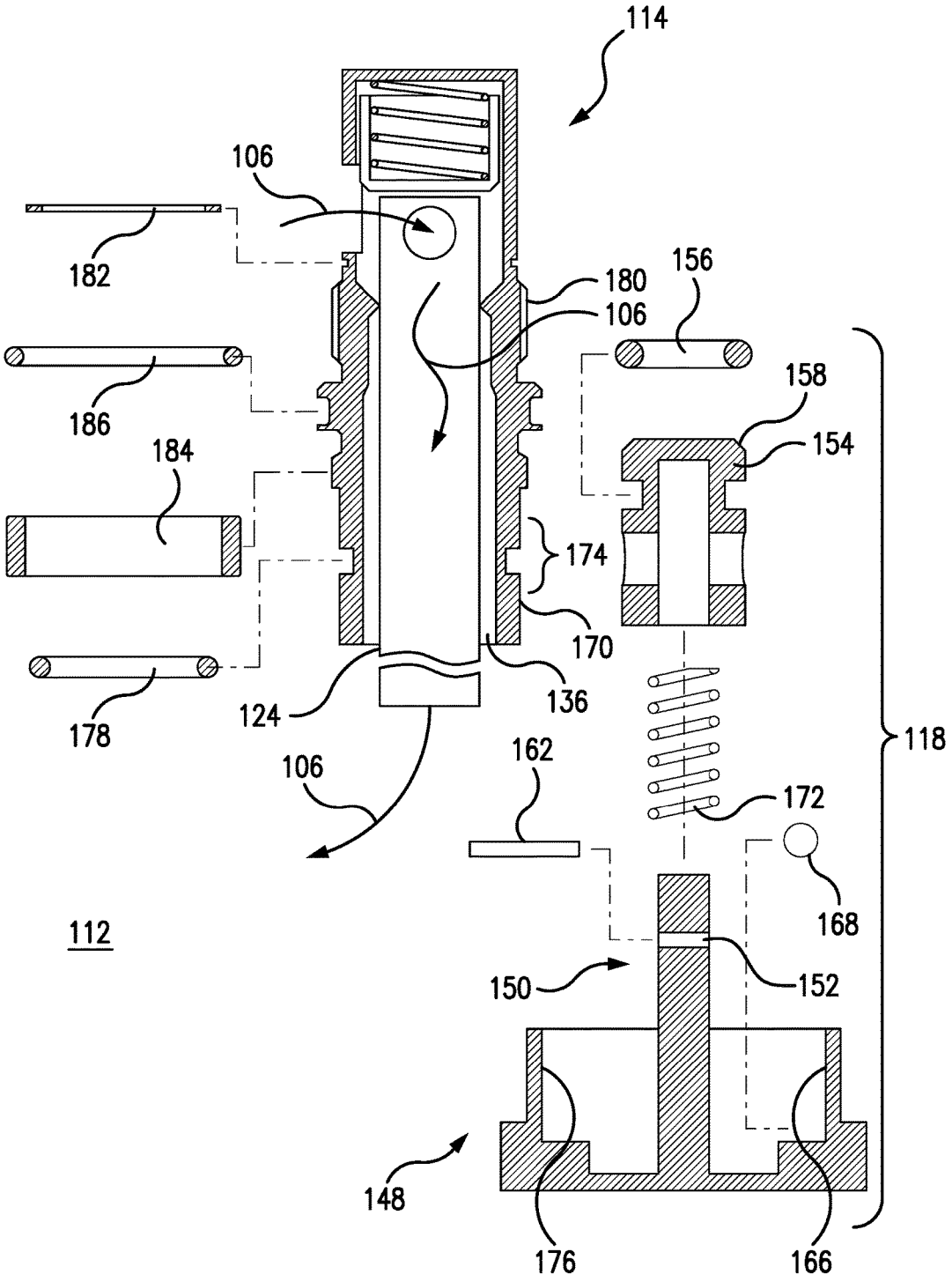
FIG. 4 is a partially exploded cross-sectional view of the drain plug assembly of FIG. 1, showing sealing and retention features of the drain plug assembly.

Secondary external seal 128 includes a valve body external surface portion 174 (shown in FIG. 4), a closure internal surface portion 176 (shown in FIG. 4), and a seal member 178 (shown in FIG. 4). Seal member 178 is seated about valve body 114 in a circumferential groove extending about valve body 114, and can be an o-ring formed from a resilient material. It is contemplated that seal member 178 can compressible seat between valve member external surface portion 174 and closure internal surface portion 176, thereby forming secondary external seal 128 between closure 118 and valve body 114 when plunger 154 is in seated positon C. Valve member external surface portion 174 can include a coating, such as paint or anodization, different than that of the remainder of valve body 114 and sump arrangement 100 to indicate to a maintainer that closure 118 is absent from valve body 114. As will be appreciated by those of skill in the art in view of the present disclosure, secondary external seal 128 can also provide sealing between valve body 114 and an externally mounted draining tool to facilitate removal of lubricant 106 from sump 102.

A bayonet connection 164 (shown in FIG. 3) is seated between closure 118 and valve body 114 in a mounting arrangement requiring depression and rotation to move closure 118 from the seated position C to the unseated positon D. Primary external seal 126 is formed between closure and valve body within an interior of valve body 114.

Retention clip 120 is arranged to seat outside of sump 102 and about valve body 114 and is removable. When retention clip 120 is arranged about valve body 114 and under closure 118 retention clip 120 prevents depression of closure 118, thereby preventing unseated closure 118. Once retention clip 120 is removed closure 118 can be depressed in an axial movement 190 (shown in FIG. 3) and rotated in a rotary movement 192 (shown in FIG. 3) such that closure 118 can be unseated and removed from valve body 114. As will be appreciated by those of skill in the art in view of the present disclosure, retention clip 120 interferes with axial movement 190 to prevent inadvertent removal of closure 118 from valve body 114 absent deliberate removal of retention clip 120 by a maintainer.

Figure 3:
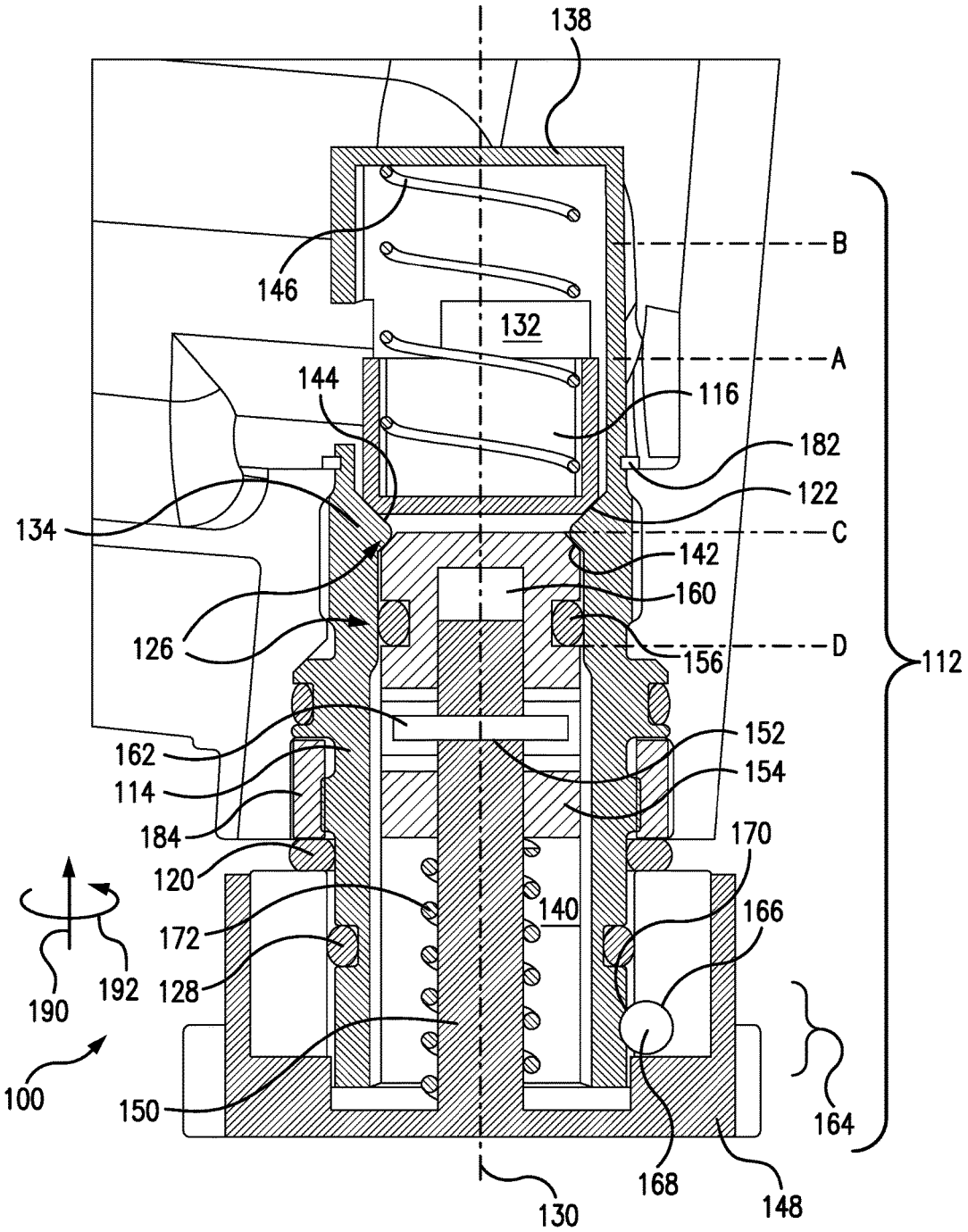
FIG. 3 is a longitudinal cross-sectional view of the sump arrangement of FIG. 1, showing the closure construction and anti-tamper/removal features of the sump arrangement.

Referring to FIG. 3, drain plug assembly 112 is shown in a longitudinal cross-section according to a first embodiment. In the illustrated exemplary embodiment valve body 114 defines a longitudinal axis 130 and has an inlet 132, a seat 134, and an outlet 136 (shown in FIG. 4). Outlet 136 is arranged on an end of valve body 114 longitudinally opposite inlet 132 and extends axially about longitudinal axis 130. Inlet 132 extends radially through valve body 114 and is longitudinally adjacent to a cap portion 138. A central bore 140 extends through an interior of valve body 114 and fluidly couples inlet 132 with outlet 136. Seat 134 is arranged within central bore 140 between outlet 136 and inlet 132 and extends radially inward from valve body 114 towards longitudinal axis 130. Seat 134 has a plunger face 142 and an opposed poppet face 144, plunger face 142 facing outlet 136 and being oblique relative to longitudinal axis 130, and poppet face 144 also being oblique relative to longitudinal axis 130.

Poppet 116 is arranged within central bore 140 between cap portion 138 and seat 134. A poppet resilient member 146 is arranged between valve body 114 and poppet 116 and is configured to bias poppet 116 towards seat 134. As shown in FIG. 3 poppet resilient member 146 is spring with opposite ends connected between cap portion 138 and poppet 116. This is for illustration purposes only and is non-limiting. Those of skill in the art will recognize that other types of resilient members can be employed to bias poppet 116 towards seat 134, as suitable for an intended application.

With reference to FIG. 4, drain plug assembly 112 is shown in an exploded cross-sectional view. Closure 118 has a head 148 and an opposed stem 150. Stem 150 is connected to head 148, extends longitudinally from head 148 and has a pin aperture 152. Pin aperture 152 extends laterally through stem 150 on an end opposite head 148. A plunger 154 with a plunger seal member 156 is slidably seated on stem 150. Plunger seal member 156, which can include a resilient o-ring or similar structure, extends circumferentially about a periphery of plunger 154 and is compressible.

In the illustrated exemplary embodiment plunger 154 has beveled face 158 defined on an end opposite head 148 which is conjugate to seat plunger face 142 (shown in FIG. 3). Beveled face 158 can conform to the contour to plunger face 142, plunger 154 thereby forming axially staggered two-part primary external seal 126 (shown in FIG. 3) defined between plunger 154 and valve body 114. It is contemplated that two-part primary external seal 126 form by compression of plunger seal member 156 against the internal surface of central bore 140 and abutment of beveled face 158 against seat plunger face 142, thereby improving the redundant sealing provided by closure 118 when closure 118 is in seated position C (shown in FIG. 3) on valve body 114.

With continuing reference to FIG. 3, plunger 154 axially overlaps pin aperture 152 and has a plunger aperture 160. A pin 162 extends through both plunger aperture 160 and stem aperture 152, pin 162 coupling plunger 154 to stem 150. Stem aperture 152 has substantially the same width as pin 162, pin 162 thereby being rigidly fixed relative to stem 150. Plunger aperture 160 is wider than stem aperture 152, which allows stem 150 to move freely (e.g., with slop) relative to plunger 154 within a limited longitudinal and radial range when plunger 154 is in seated position C. The limited longitudinal and radial movement range of to stem 150 relative to plunger 154 afforded by plunger aperture 160 allows for operation of bayonet connection 164, which is arranged between closure head 148 and valve body 114 without interruption of primary external seal 126.

Bayonet connection 164 includes a socket 166, a retention ball 168, and slot 170. Socket 166 is defined within an inner recess of head 148. Slot 170 is defined within valve body 114 and extends helically about valve body 114 from a location longitudinally overlapping outlet 136 towards seat 134. Retention ball 168 is seated in socket 166 such that it is fixed relative to closure head 148, protrudes from socket 166, and is slidably received within slot 170. Slot 170 has helical pitch extending at least partially about valve body 114. The helical pitch of slot 170 is such that head 148 must be depressed towards valve body 114 and turned (i.e. rotated about longitudinal axis 130 when closure 118 is seated on valve body 114) in order to unseat closure 118 from valve body 114. Since retention clip 120 is arranged between sump 102 and head 148, head 148 cannot be depressed when retention clip 120 is seated about valve body 114. This prevents head 148 from being depressed for removal without retention clip 120 being removed, thereby reducing the likelihood of the closure 118 being unseated by vibration or other environmental effects. Employment of the depress-and-turn ball retention arrangement of bayonet connection 164 allows outlet 136 to have a relatively large diameter, e.g., larger than a flow area defined by seat 134 in the illustrated exemplary embodiment, facilitating flow of lubricant 106 from sump interior 108 and through valve body 114.

A plunger resilient member 172 is arranged between plunger 154 and closure head 148. Plunger resilient member 172 is configured to bias plunger 154 towards an end of closure stem 150 opposite closure head 148. The biasing is such that, once internal seal 122 is established, head 148 is urged axially away from valve body 114 and helically along slot 170, opening a gap between sump 102 and closure head 148 for the insertion of retention clip 120. If the gap width subsequent to seating is sloppy, i.e. exceeds the axial height of retention clip 120, the sloppy fit informs the maintainer plunger 154 is not bottomed out against seat 134, and the closure can be reinstalled and/or central bore 140 checked for foreign material. This ensure that plunger 154 bottoms out in abutment with seat plunger face 142, thereby providing two-part primary external seal 126.

With further reference to FIG. 4, drain plug assembly 112 includes one or more anti-tamper/removal features that cooperate with the installation of valve body 114 in sump 102 (shown in FIG. 1) to prevent removal of valve body 114 from sump 102. In this respect valve body 114 has a threaded segment 180, an internal retention ring 182, and an external lock ring 184. The anti-tamper/removal features allow for a static seal 186, e.g., an o-ring, to be arranged between valve body 114 and sump 102 which is never disturbed subsequent to installation of drain plug assembly 112, reducing the likelihood of leakage through drain 104 (shown in FIG. 2).

Threaded segment 180 is arranged to threadably seat valve body 114 in sump 102 and forms the primary retention mechanism of valve body 114 in sump 102. It is contemplated that threaded segment 180 can have a diameter that is about 0.750 inch (about 1.905 centimeters) diameter. Diameters of around this size can provide sufficiently large flow areas such that the flow rate of lubricant 106 (shown in FIG. 1) through valve body 114 from sump 102 is sufficient to drain lubricant from helicopter transmission sumps at low temperatures, allowing for cold lubricant changes and/or lubricant changes in extreme environments where lubricant viscosity can be low.

Internal retention ring 182 is arranged within interior 108 (shown in FIG. 2) of sump 102 and has a lateral width that is greater than drain 104 (shown in FIG. 2). This prevents external removal of valve body 114 from sump 102. In accordance with certain embodiments, internal retention ring 182 can be attached to an interior wall of sump 102 by fastener. It is also contemplated that internal retention ring 182 can be fastened to sump 102 by two or more fasteners housed within sump interior 108 and received therein from the sump interior, thereby providing redundant fastening and preventing removal of valve body from the exterior of sump 102.

External lock ring 184 is seated about valve body 114 and radially between valve body 114 and sump 102 (shown in FIG. 3). External lock ring 184 is arranged to prevent rotation of valve body 114 within drain 104, rendering it impossible to remove valve body 114 from sump 102. As will be appreciated by those of skill in the art, in some operating environments maintainers remove the drain plug or valve body in its entirety from the sump drain. This is typically done to reduce the time necessary for lubricant to drain from the sump with the intention of reducing the cycle time for lubricant change, potentially improving aircraft availability, by increasing the rate of lubricant flow from drain 104 (shown in FIG. 2). This invites leakage in the event that the drain plug assembly is not re-installed correctly.

In embodiments described herein external lock ring 184 prevents removal of valve body 114 from sump 102 absent fracture of sump 102. This prevents removal of valve body 114 from sump 102 and avoids the risk of reinstallation error otherwise invited by removal of valve body 114. It is contemplated that external lock ring 184 can include a relatively soft material, which allows external lock ring 184 to be pressed into a radial gap defined between valve body 114 and sump 102. In certain embodiments, external lock ring 184 fixes valve body 114 in rotation within drain 104 by engaging one or more radially inner splines defined on the exterior of valve body 114 and further engaging one or more radially outer splines defined by sump 102 within drain 104. Internal retention ring 182 can seat about valve body 114 within interior 108 of sump 102. Internal retention ring 182 can in turn be fastened to the interior surface of sump 102 from within sump interior 108, thereby cooperating with external lock ring 184 to prevent removal of valve body 114 from sump 102.

The methods and systems of the present disclosure, as described above and shown in the drawings, provide for self-closing drain plugs with superior properties including redundancy, self-closure, and/or one or more anti-tamper/removal features. While the apparatus and methods of the subject disclosure have been shown and described with reference to preferred embodiments, those skilled in the art will readily appreciate that change and/or modifications may be made thereto without departing from the scope of the subject disclosure.

What is claimed is:

1. A drain plug assembly, comprising:

a valve body having a central bore extending between an inlet and an axially opposite outlet, the bore having a seat arranged between the inlet and the outlet of the valve body;

a removable closure having a seated position and an unseated position, the closure being spaced apart from the seat in the unseated position, the closure abutting the seat in the seated position to form an outer seal fluidly isolating the outlet from the inlet;

a poppet arranged in the bore on a side of the seat opposite the outlet and movable between an open position and a closed position, the poppet being spaced apart from the seat in the open position, the poppet abutting the seat in the closed position to form an inner seal fluidly isolating the outlet from the inlet; and a resilient member arranged between the inlet and the poppet, wherein the resilient member is configured to bias the poppet towards the poppet closed position to fluidly separate inlet from the outlet when the closure is in the seated and unseated positions.

2. The drain plug assembly as recited in claim 1, wherein the poppet is disposed on a side of the inlet opposite the seat when the poppet is in the open position.

3. The drain plug assembly as recited in claim 1, wherein the inlet extends laterally through the valve body.

4. The drain plug assembly as recited in claim 1, wherein the outlet extends longitudinally through the valve body.

5. The drain plug assembly as recited in claim 1, further comprising a poppet biasing member arranged between the valve body and the poppet, the poppet biasing member arranged to bias the poppet toward the poppet closed position.

6. The drain plug assembly as recited in claim 1, wherein the closure includes a stem connected to a head, the stem extending longitudinally in the central bore in the seated position.

7. The drain plug assembly as recited in claim 6, further comprising a plunger slidably seated on an end of the stem opposite the head.

8. The drain plug assembly as recited in claim 7, further comprising a plunger biasing member arranged between the head and the plunger, the plunger biasing member configured to bias the plunger toward an end of the stem opposite the head.

9. The drain plug assembly as recited in claim 6, further comprising a ball retention arrangement coupling the closure to the valve body in the seated position.

10. The drain plug assembly as recited in claim 6, further comprising a seal member extending about the valve body longitudinally between the seat and the outlet, the seal member cooperating with the closure in the seated position to form a secondary external seal.

11. The drain plug assembly as recited in claim 6, wherein the plunger has a periphery conforming to the seat and further comprising seal member offset from the plunger periphery.

12. The drain plug assembly as recited in claim 1, further comprising a static seal member extending circumferentially about the valve body longitudinally between the seat and the outlet.

13. The drain plug assembly as recited in claim 12, further comprising lock ring seated about the valve body on a side of the static seal member opposite the seat.

14. The drain plug assembly as recited in claim 12, wherein the valve body has an external spline arranged longitudinally between the static seal and the outlet.

15. The drain plug assembly as recited in claim 1, wherein the valve body has an external threaded segment longitudinally overlapping the seat.

16. The drain plug assembly as recited in claim 1, further comprising a bayonet connection coupling the closure to the valve body when the closure is in the seated position.

17. A sump arrangement, comprising:

a sump with a drain;

a drain plug assembly as recited in claim 1; and a lock ring arranged in the drain between the valve body and the sump, wherein removal of the valve body from the drain requires fracturing the lock ring.

18. The sump arrangement as recited in claim 17, further comprising a compressed static seal member arranged in the drain between the sump and the valve body.

19. The sump arrangement as recited in claim 17, wherein the closure includes a stem connected to a head, the stem extending longitudinally in the central bore in the seated position, and further comprising a retention clip mounted between the head and the lock ring preventing the head from being depressed for removal.

20. A drain plug kit, comprising:

a drain plug assembly as recited in claim 1, wherein the poppet is arranged for self-closure of the valve body and sealing of the valve body bore with an internal seal, wherein the closure is arranged for sealing the valve body bore with a primary external seal and a secondary external seal;

a ring lock arranged to seat about the valve body for permanently fixing the valve body in a sump drain; and a retention clip arranged to seat about a portion valve body longitudinally between the seat and the outlet and configured to prevent removal of the closure from the valve body outlet.

* * * * *